US007874248B2

(12) United States Patent
Hiroyuki

(10) Patent No.: US 7,874,248 B2
(45) Date of Patent: Jan. 25, 2011

(54) TYPING DEVICE, PRINTER AND CARD CASE WITH PRINTING FUNCTION

(76) Inventor: Hayashi Hiroyuki, 312-3, Nakaiwase, Ooaza, Hanyu-shi, Saitama 3480046 (JP)

( * ) Notice: Subject to any disclaimer, the term of this patent is extended or adjusted under 35 U.S.C. 154(b) by 802 days.

(21) Appl. No.: 11/795,170

(22) PCT Filed: Jan. 26, 2006

(86) PCT No.: PCT/JP2006/001217

§ 371 (c)(1),
(2), (4) Date: Jul. 11, 2007

(87) PCT Pub. No.: WO2006/080391

PCT Pub. Date: Aug. 3, 2006

(65) Prior Publication Data

US 2008/0152415 A1 Jun. 26, 2008

(30) Foreign Application Priority Data

Jan. 27, 2005 (JP) ..... 2005-019045

(51) Int. Cl.

| | |
|---|---|
| ***B41F 19/02*** | (2006.01) |
| ***B31F 1/07*** | (2006.01) |
| ***B41J 1/00*** | (2006.01) |
| ***B41J 1/18*** | (2006.01) |
| ***B41J 3/36*** | (2006.01) |
| ***B41K 1/10*** | (2006.01) |

(52) U.S. Cl. ..... 101/20; 101/29; 101/30; 400/134.4

(58) Field of Classification Search ..... 101/93, 101/93.11, 93.13, 93.18–93.19, 20, 29–30; 400/145–145.1, 149, 521, 536, 134.4, 138.4, 400/138.6, 132, 134

See application file for complete search history.

(56) References Cited

U.S. PATENT DOCUMENTS

| | | | | |
|---|---|---|---|---|
| 2,968,237 | A * | 1/1961 | Katz | 101/66 |
| 3,181,679 | A * | 5/1965 | Stubbmann | 400/134.4 |
| 3,643,774 | A * | 2/1972 | Kondur, Jr. | 400/144.3 |

(Continued)

FOREIGN PATENT DOCUMENTS

| | | |
|---|---|---|
| JP | 61-287780 | * 12/1986 |

(Continued)

*Primary Examiner*—Ren Yan
*Assistant Examiner*—Marissa L Ferguson-Samreth
(74) *Attorney, Agent, or Firm*—Levisohn Berger LLP

(57) ABSTRACT

Date can be printed on a business card in a business card case by realizing a business card case with a printing function. The business card case with a printing function includes an upper case (1) provided with a pressing rubber (12) and a pressing block (13) of a printing hammer, a lower case (2) connected to the upper case (1) so as to be freely opened and closed, a card containing section (3) formed in the case, a typing device in which a plurality of date printing type units coupled so as to move up and down among a plurality of type blocks each having a type formed on the upper surface are fixed to a type case (4), and a printing ribbon (5) for printing the date. The date is printed by pressing the print hammer and pressing the business card (34) against the type with the printing ribbon (5) interposed therebetween.

9 Claims, 14 Drawing Sheets

PERSPECTIVE VIEW SHOWING NAME CARD CASE ACCORDING TO EMBODIMENT 1

U.S. PATENT DOCUMENTS 3,865,224 A * 2/1975 Faust et al. ..... 400/134.4
3,901,143 A * 8/1975 Alexander et al. ..... 101/18
4,237,784 A * 12/1980 Suzuki ..... 101/20
4,321,868 A * 3/1982 Kikuchi ..... 101/111
5,396,840 A * 3/1995 Olson ..... 101/45
2006/0000376 A1 * 1/2006 Faber ..... 101/382.1

FOREIGN PATENT DOCUMENTS

WO 86/07570 * 12/1986
WO 2004/045856 * 6/2004

* cited by examiner

PERSPECTIVE VIEW SHOWING NAME CARD CASE ACCORDING TO EMBODIMENT 1

VIEW SHOWING NAME CARD CASE ACCORDING TO EMBODIMENT 1

(a)

(b)

VIEW SHOWING TYPE CASE

VIEW SHOWING NAME EXAMPLE OF TYPE UNIT

VIEW SHOWING ANOTHER EXAMPLE OF TYPE UNIT

VIEW SHOWING TYPE BASE

VIEW SHOWING STATE WHERE TYPE BLOCK IS ALLOWED TO FIT INTO TYPE BASE

VIEW SHOWING STATE WHERE ANOTHER TYPE BLOCK IS ALLOWED TO FIT INTO TYPE BASE

PLAN VIEW OF TYPE DEVICE

VIEW SHOWING RIBBON FRAME

VIEW SHOWING PRINTING RIBBON

VIEW SHOWING PROTECTOR FRAME

PLAN VIEW OF RIBBON PROTECTOR

ENLARGED SECTIONAL VIEW OF PRINTING PORTION

VIEW SHOWING NAME CARD CASE ACCORDING TO EMBODIMENT 2

VIEW SHOWING PROTECTOR FRAME

VIEW SHOWING LEVER-OPENED STATE

VIEW SHOWING LEVER-CLOSED STATE

TYPING DEVICE, PRINTER AND CARD CASE WITH PRINTING FUNCTION

TECHNICAL FIELD OF THE INVENTION

The present invention relates to a typing device, and a printer which are suitable for printing date on a business card in a business card case, and the business card case with a printing function using said typing device and said printer.

BACKGROUND OF THE INVENTION

A business card is often used in business, social intercourse, or the like while also serving as a simple self-introduction. However, it is sometimes hard to remember a time of meeting with the person of exchanged business cards, since exchanged business cards do not have written date thereon.

Therefore, there are some people who write date, place, and the like on a business card after receipt of said business card. However, if it is possible to hand over a business card with the date printed thereon, there is no need for a receiver to write the date. This seems to be convenient for receivers and senders.

However, conventional business card cases can only contain business cards, and there is not available a business card case with a printing function.

On the other hand, as for the printers, there are available many printers for performing printing business cards. As the printer for printing a given date on printed business cards, there is known a printer in which a business card is sandwiched between a thermal head-a platen section and a drive roller—a pressing roller section, and then pulling out the business card in that state, thereby generating a control signal to print a current date or a specific date (see Patent Document 1).

Patent Document 1: JP 09-58095 A

SUMMARY OF THE INVENTION

Problem to be Solved by the Invention

The conventional printer is designed to print a given date on a business card, which is received on that day or in the past, and is used at home, office, or the like, so the conventional printer is not designed so as to carry on a daily basis.

Moreover, The conventional printer device performs the printing by driving a thermal head by electric power under electronic control, so there are required the thermal head, a battery, a CPU, a memory, a display, various switches, and the like, resulting in large in size and weight. Thus, it is impossible to accommodate and carry the device in the business card case.

A problem to be solved is to provide a typing device and a printer which can be applied to a business card case with a printing function, to thereby realize the business card case with a printing function, and to enable printing a given date on the business card in the business card case.

Means for Solving the Problem

According to the present invention, there is used a typing device including: a plurality of type units for printing date, in which a plurality of type blocks having types on upper surfaces thereof are coupled to each other so that the type blocks can move up and down; a type case having a plurality of grooves, into which the plurality of type units are inserted, formed concentrically; and a type base fixed to a predetermined position of the type case, for positioning the type blocks for setting a given date, thereby realizing a thin business card case with a printing function, and enabling printing a given date on a business card in the business card case.

According to the present invention, a printer is used which includes: a typing device having: a plurality of type units for printing a given date, in which a plurality of type blocks having types on upper surfaces thereof are coupled to each other so that said type blocks can move up and down; a type case having a plurality of grooves, into which said plurality of type units are inserted, formed concentrically; and a type base fixed to a predetermined position of said type case, for positioning said type blocks for setting a given date; a printing ribbon arranged on the typing device; and a ribbon protector provided with a window which is arranged on said printing ribbon, and through which a type set in a printing position protrudes, thereby realizing the thin business card case with a printing function, and enabling printing a given date on the business card in the business card case.

According to the present invention, there is realized a name card case with a printing function, characterized by including: (A) an upper case provided with printing hammer means; (B) a lower case connected to said upper case so that said upper case is controllably opened and closed; (C) a card containing section formed in an inside of said name card case; (D) a printer, including: (1) a type device having: (a) a plurality of type units for printing date, in which a plurality of type blocks having types on upper surfaces thereof are coupled to each other so that said type blocks can move up and down; (b) a type case having a plurality of grooves, into which the plurality of type units are inserted, formed concentrically; and (c) a type base fixed to a predetermined position of the type case, for positioning the type blocks for setting the date; (2) a printing ribbon arranged on the type device; and (3) a ribbon protector provided with a window which is arranged on the printing ribbon, and through which a type set in a printing position protrudes, the printer being provided for printing date on a name card contained in the card containing section, in which the print hammer means is pressed to impress the name card to the type through an intermediation of the printing ribbon to thereby print a given date, thereby enabling printing a given date on the name card in the name card case.

Effects of the Invention

According to the present invention, a business card case includes a printing hammer means, a printer having a typing device, and a card containing section, so it is possible to print date on a business card in the business card case by pressing the printing hammer means.

Thus, by setting types to a current date in advance, when exchanging a business card, it is possible to print a given date and hand the business card with the date to a person with whom the business cards are exchanged.

Further, according to the present invention, there is no need for electric power and electronic control, so it is possible to realize the light and inexpensive business card case with a printing function.

Further, the types are arranged concentrically to constitute the thin typing device, so the thin business card case with a printing function can be realized.

DESCRIPTION OF REFERENCE NUMERALS

Figure 1:
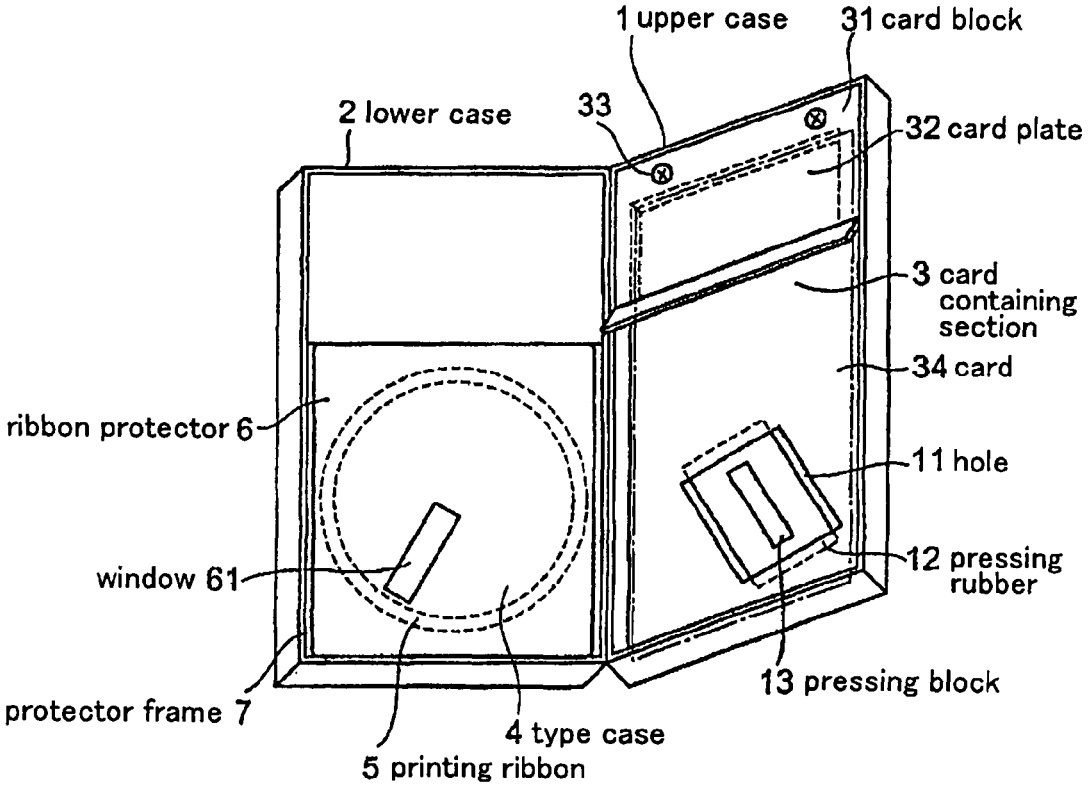
FIG. 1 is a perspective view showing a business card case according to Embodiment 1 of the present invention.

1 uppercase
2 lower case
3 card containing section
4 type case
5 printing ribbon
6 ribbon protector
7 protector frame
8 type unit
9 type base
11 hole
12 pressing rubber
13 pressing block
31 card block
32 card plate
33 screw
34 card
41 groove
42 wall
43 non-groove area
51 ribbon frame
52 adhesion portion
53 cut
61 window
71 shaft
72 spring
73 hole
74 side plate
75 rotation hole
81 type
82 type block
83 spacer
84 string
85 through hole
86 stopper
91 slope
92 depressed portion
200 lower case
201 square hole
202 claw
203 lever
204 stopper
205 hole
206 spring
207 support body
700 protector frame
701 shaft
702 spring
703 hole
704 side plate
705 rotation hole
706 support body
707 protrusion
708 protrusion
800 type unit
801 type
802 type block
803 coupling portion

DETAILED DESCRIPTION OF THE PREFERRED EMBODIMENT

According to the present invention, there is realized a business card case with a printing function, characterized by including: (A) an upper case provided with printing hammer means; (B) a lower case connected to said upper case so that said upper case is controllably opened and closed; (C) a card containing section formed in an inside of said business card case; (D) a printer, including: (1) a typing device having: (a) a plurality of type units for printing date, in which a plurality of type blocks having types on upper surfaces thereof are coupled to each other so that said type blocks can move up and down; (b) a type case having a plurality of grooves, into which the plurality of type units are inserted, formed concentrically; and (c) a type base fixed to a predetermined position of the type case, for positioning the type blocks for setting the date; (2) a printing ribbon arranged on the typing device; and (3) a ribbon protector provided with a window which is arranged on the printing ribbon, and through which a type set in a printing position protrudes, the printer being provided for printing date on a business card contained in the card containing section, in which the print hammer means is pressed to impress the business card to the type through an intermediation of the printing ribbon to thereby print a given date, thereby enabling printing a given date on the business card in the business card case.

Embodiment 1

FIG. 1 is a perspective view showing a name card case with a printing function according to Embodiment 1 of the present invention, showing a state where the upper case is opened.

The name card case is composed of an upper case 1 and a lower case 2 constituting a box shape, and a card containing section 3 formed inside the cases. The upper case 1 is connected to the lower case 21 by a hinge or the like so as to be rotatably opened and closed.

The upper case 1 is provided with a hole 11 and has, correspondingly to the hole 11, a pressing rubber 12 working as printing hammer means, and a pressing block 13 fixed to the pressing rubber 12 by an adhesive or the like, and said pressing block 13 has a width smaller than that of the pressing rubber 12. The pressing rubber 12 is formed of rubber or an elastic synthetic resin material, and the pressing block 13 is formed of a synthetic resin plate or the like.

Further, to the upper case 1, a card block 31 of an angular U-shaped configuration and a card plate 32 are fixed by screws 33 or the like, thereby forming the card containing section 3. The card block 31 is formed of a synthetic resin or the like and has a thickness of about ten sheets of the business cards 34. The width of said angular U-shaped configuration corresponds to a length of a shorter side of the business card 34.

The card plate 32 is formed of the synthetic resin plate or the like and has a slight gap in an inside thereof for facilitating loading and unloading of the business card 34.

The type case 4 to which the type unit described later is mounted is fixed to the lower case 2 by a screw or the like, and there is arranged a printing ribbon 5 on which a ribbon protector 6 capable of opening and closing is arranged on the type case 4.

The ribbon protector 6 is formed of a metal plate and is fixed to a protector frame 7 by an adhesive or the like. The ribbon protector 6 is also provided with a window 61 through which types set in a printing position protrude together with the printing ribbon 5. Said window 61 is opened corresponding to the pressing block 13 of the printing hammer means.

The window 61 and the pressing block 13 are inclined in order to avoid overlapping with a name printing portion of a business card 34, when a date printing is performed on a right surface of said business card 34. However, when a date printing is performed on a back surface having no printing thereon, such a consideration is not necessary, so the window 61 and the pressing block 13 may be in parallel with a longer side or the shorter side of the business card 34.

When printing a date, the upper case 1 containing about ten sheets of the business cards 34 is closed, and the printing rubber 12 is pressed by a finger, thereby the pressing block 13 moves in a printing direction, which is downward direction in fact, to press an entirety of the business cards 34 contained in the card containing section 3. Thus, the business cards 34 is impressed to the types for date protruding from the window 61 of the ribbon protector 6 through the intermediation of the printing ribbon 5 to print a given date.

When the finger is taken off after completion of the printing, the block 13 moves to an opposite direction of the printing direction, which is upward direction, to return to original position, due to a restoring force of the pressing rubber 12.

Said upper case 1 and said lower case 2 may be formed by machining a metal plate, for example, an aluminum plate or may be formed of a synthetic resin.

Also, those may be formed of a soft synthetic resin, cloth, or the like. In addition, those shapes are not restricted to have a box shape. Said cases may be formed by any shape or material as long as they can accommodate the business cards and the printer.

Figure 2:
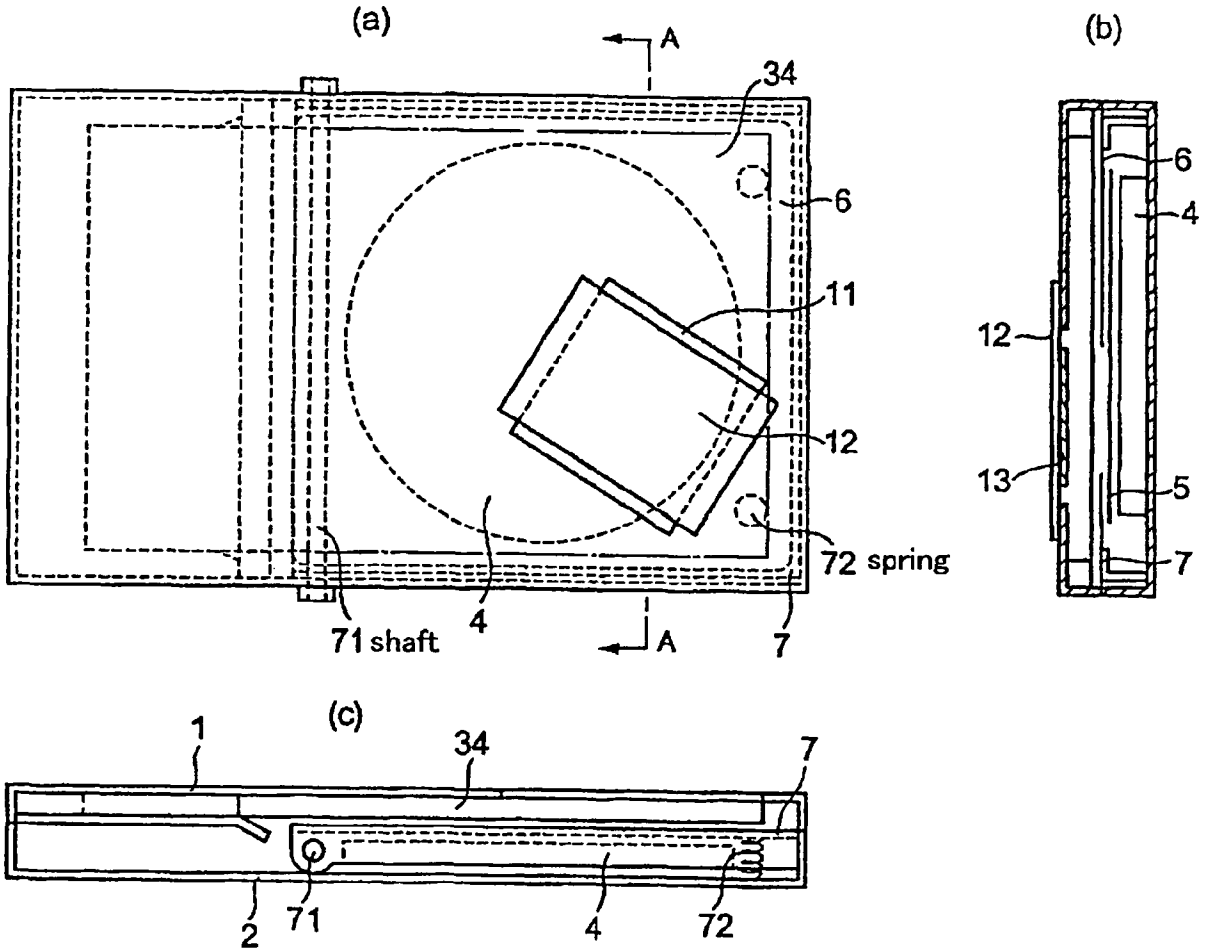
FIG. 2 is a view showing the business card case according to Embodiment 1.

FIG. 2 is a view showing Embodiment 1 of a business card case according to the present invention, in which part (a) is a plan view, part (b) is a sectional view taken along the line A-A, and part (c) is a side view with a side plate being removed.

The ribbon protector frame 7 to which the ribbon protector 6 is fixed is supported by a shaft 71, so that the ribbon protector frame can be rotated on said shaft 71. If users set a given date or change a position of the printing ribbon 5, the ribbon protector 7 is rotated on shaft 71, and users can treat the ribbon protector frame 7 opened there with a opened state of the upper case 1. Further, in a position opposite to the protector frame 7, there is provided a spring 72 which is an elastic body, wherein said spring 72 urges the protector frame 7, which is the ribbon protector 6, to the upper side.

The pressing block 13 forming the printing hammer means is fixed to lower side of the pressing rubber 12 to be accommodated in the hole 11, but said pressing block may be fixed to upper side of the pressing rubber 12. In this case, there is an advantage in that a position to be pressed by a finger is obvious, but a thickness of the business card case increases on the thickness of the pressing block 13.

When the pressing rubber 12 is pressed, the pressing block 13 presses the business card 34 to impress the business card 34 to the types in the type case 4 through the intermediation of the printing ribbon 5, thereby performing a printing operation.

Figure 3:
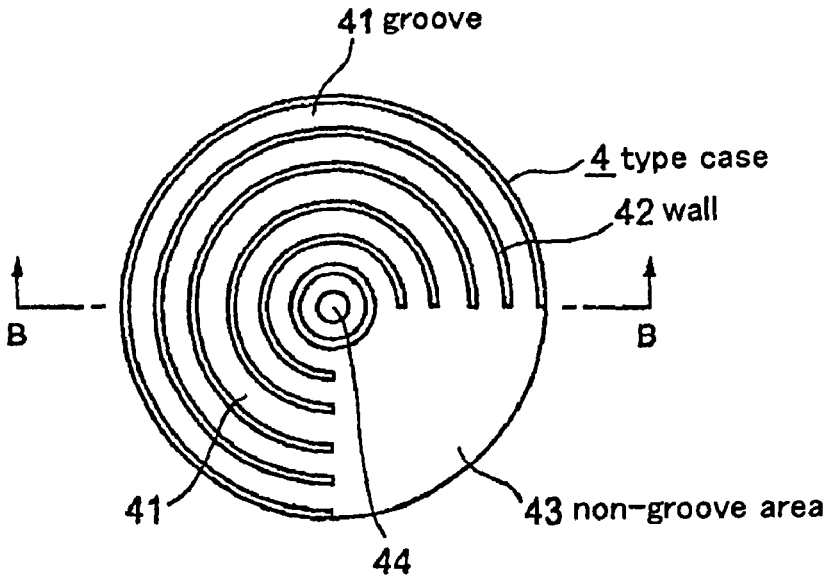
FIG. 3 is a view showing a type case.
Figure 3:
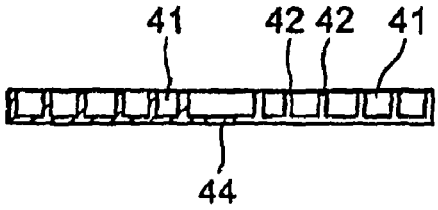

FIG. 3 is a plan view showing the type case, in which a part (a) is a plan view and a part (b) is a sectional view taken along the line B-B.

The type case 4 is mounted with the type units, and is formed of metal or a synthetic resin, and a plurality of grooves 41 are formed concentrically. Said grooves 41 is structured by forming circular arc walls 42 which are concentrically formed. In FIG. 3, there is formed a non-groove area 43, and both ends of the plurality of grooves 41 are connected to the non-groove area 43. Said grooves 41 may be formed to be annular without forming the non-groove area 43.

Further, the type case 4 may be formed of independent rings by grooves 41, wherein said rings may comprised concentrically.

Note that, a hole 44 for screwing the type case 4 is provided in center of said concentrically formed grooves, but said hole is not required if said type case is adhered to the lower case.

Figure 4:
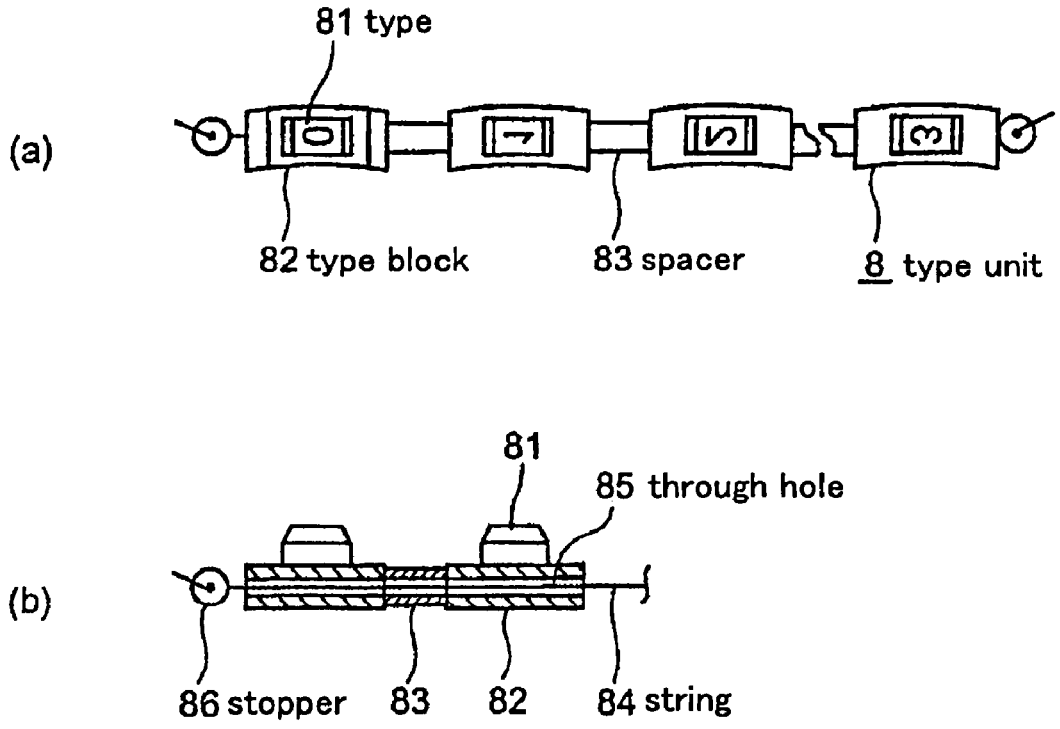
FIG. 4 is a view showing an example of a type unit.

FIG. 4 is a view showing an example of the type unit, in which a part (a) is a plan view and a part (b) is a sectional view.

The type unit 8 is composed of a plurality of type blocks 82 each having formed on an upper surface thereof a type 81, a plurality of spacers 83 constituting coupling portions between the type blocks 82, and a string 84 for coupling those.

The type block 82 is formed of a synthetic resin, rubber, or the like, and the upper surface of said type block 82 has the type 81 for printing date. The type block 82 is provided with a through hole 85 into which the string 84 is inserted, in central/middle portion of the main body of said type block.

The type 81 may be formed of a synthetic resin, rubber, or the like to be adhered to the main body, or the type 81 and the main body are integrally formed to form the type block 82.

The spacer 83 has a through hole in a center thereof, and is formed of a synthetic resin or the like. There are provided the spacers of various lengths.

The string 84 may be formed of any string-like member. Any rigid string-like member can be used there such as a kite string, a fishing line, and the like.

The type unit 8 is obtained by alternately providing the plurality of type blocks 82 and spacers 83, and coupling those by a string 84. In order to allow the slight up and down movement of the type blocks 82, the plurality of type blocks 82 are loosely coupled to each other by said string 84.

In FIG. 4, both ends of the coupled type unit 8 are terminal ends, and the string 84 is fastened by stoppers 86. However, the type unit 8 may be formed of an annular shape without both ends.

Figure 5:
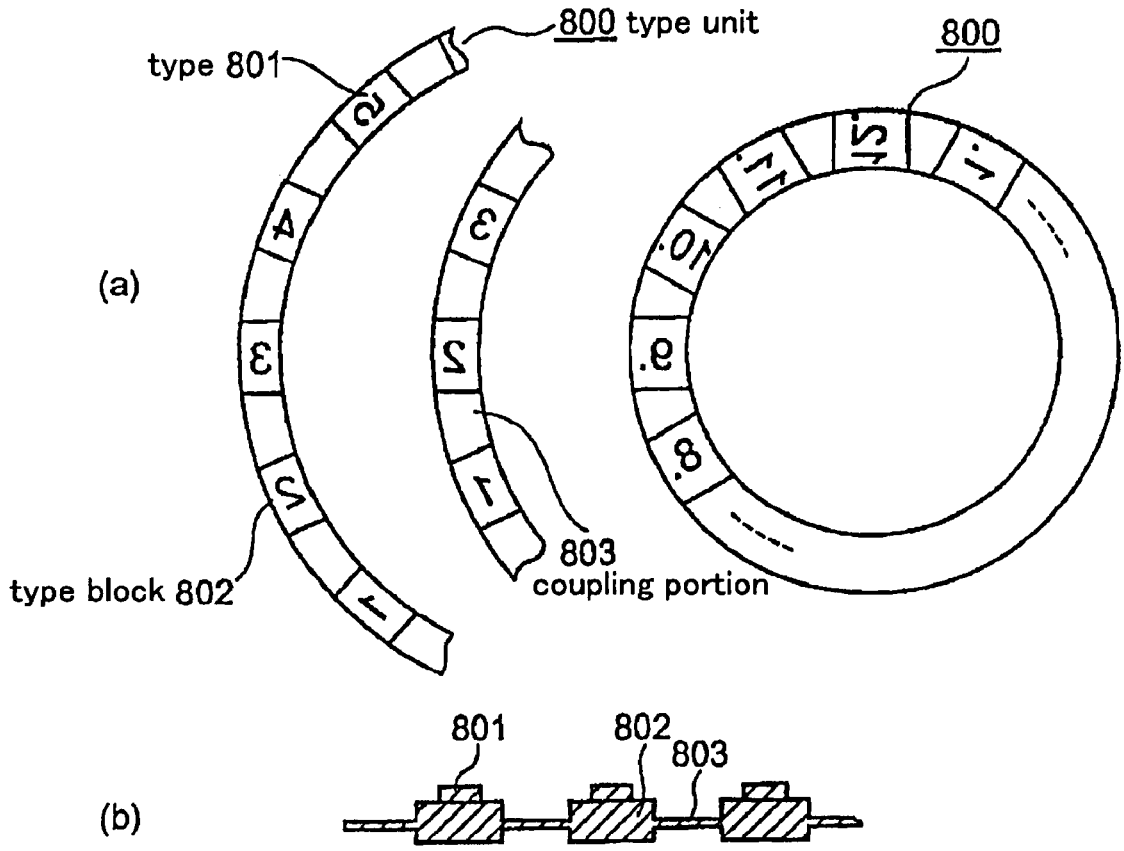
FIG. 5 is a view showing another example of a type unit.

FIG. 5 is a view showing a type unit of another example, in which a part (a) is a plan view of the type unit indicating a date in month-day format, and a part (b) is a sectional view of the type unit.

A type unit 800 are integrally formed of a plurality of type blocks 802 each having formed on upper surface thereof a type 801 and coupling portions 803 for coupling the type blocks 802 to each other. Said type unit 800 are formed of a member of a soft material, for example, a synthetic resin or rubber. The type unit 800 is formed in a circular arc shape corresponding to the groove 41 of the type case 4 shown in FIG. 3.

The type unit 800 may have both ends as terminal ends or may be formed in an annular shape like the type unit 800 for printing a given month shown rightmost in the part (a) of FIG. 5. As a matter of course, the type of the date may correspond to any linguistic style.

In the type unit 800, the coupling portion 803 is formed to be thinner than the type block 802 so that the type block 802 can slightly move up and down, thereby providing the same function as that of the type unit 8 having the type blocks loosely coupled to each other shown in FIG. 4.

Note that, the type unit 800 may be obtained by integrally structuring the type blocks 802 formed of a hard synthetic resin or metal, and the coupling portions 803 formed of synthetic resin plates or metal plates thinner than the type blocks 802.

Figure 6:
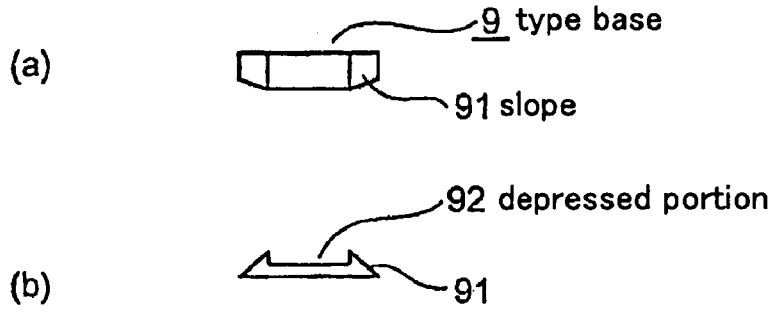
FIG. 6 is a view showing a type base.

FIG. 6 is a view showing a type base, in which a part (a) is a plan view, and a part (b) is a front view.

Type bases 9 are allowed to fit into predetermined positions of the type case 4 shown in FIG. 3, for example, predetermined positions of the grooves 41 to be fixed thereto by an adhesive or the like, and serve for positioning the type blocks for setting the date. Accordingly, there are prepared the number of type bases 9 corresponding to the number of the type units, and are fixed inside the grooves 41 by being aligned in one line in the date printing position.

The type base 9 is formed, for example, of a synthetic resin, and is formed, in a central portion thereof, with a depressed portion 92, which has slopes 91 on both sides and into which the type block is allowed to fit.

A length in a longitudinal direction of the depressed portion 92 allows fitting of the type block in a longitudinal direction thereof in close contact, and a width of the depressed portion allows the fitting of the type block in a direction of the shorter side thereof.

Further, as a matter of course, the type bases 9 arranged in a line and the type case 4 may be integrated to each other.

Figure 7:
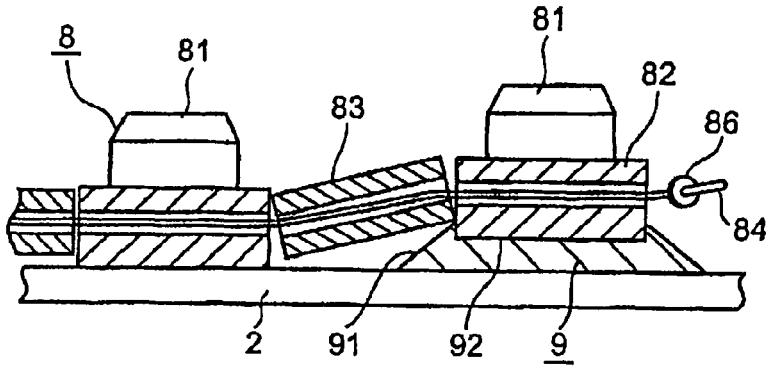
FIG. 7 is a view showing a state where a type block is allowed to fit into the type base.
Figure 8:
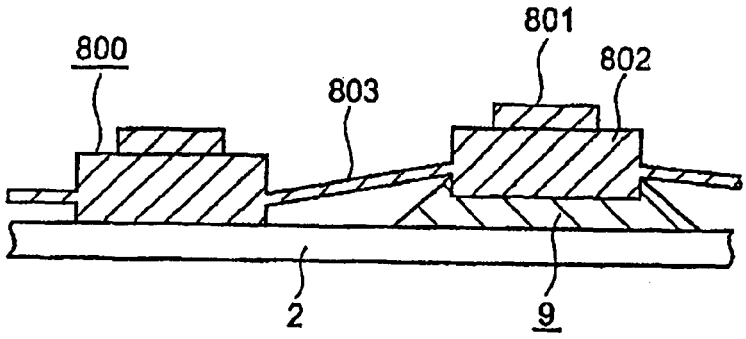
FIG. 8 is a view showing a state where another type block is allowed to fit into the type base.

FIGS. 7 and 8 are views each showing a state where the type block is allowed to fit into the type base, and are each a sectional view of the type bases and the type blocks aligned in a line, viewed from a lateral direction.

FIG. 7 shows an example in which the type block 82 of the type unit 8 shown in FIG. 4 is allowed to fit into the type base 9. At this time, in the spacer 83 between the type blocks 82, the string 84 is loosened, so a positive inclination is generated.

When setting the date, each of the type units 8 is picked and pulled with fingers or a tool such as tweezers, thereby sliding the type blocks 82 having the types 81 indicating a year, a month, and a day in the grooves 41 of FIG. 3 to be allowed to fit into the depressed portions 92 of the type bases 9 fixed in the printing position by using the slopes 91. Note that, a protrusion-like tab may be provided somewhere in the type unit 8 to be picked by fingers.

As a result, the types 81 of the type blocks 82 set in the type bases 9 are positioned at a higher level than the other types 81, thereby being ready for the printing operation.

FIG. 8 shows an example in which the type block 802 of the type unit 800 shown in FIG. 5. In this case, the coupling portion 803 between the type blocks 802 is formed of a thin and soft material, so a positive inclination is generated on a left side of the type blocks 802 and a negative inclination is generated on a right side of the type blocks 802.

Setting of the date is performed in the same manner as in FIG. 7.

Figure 9:
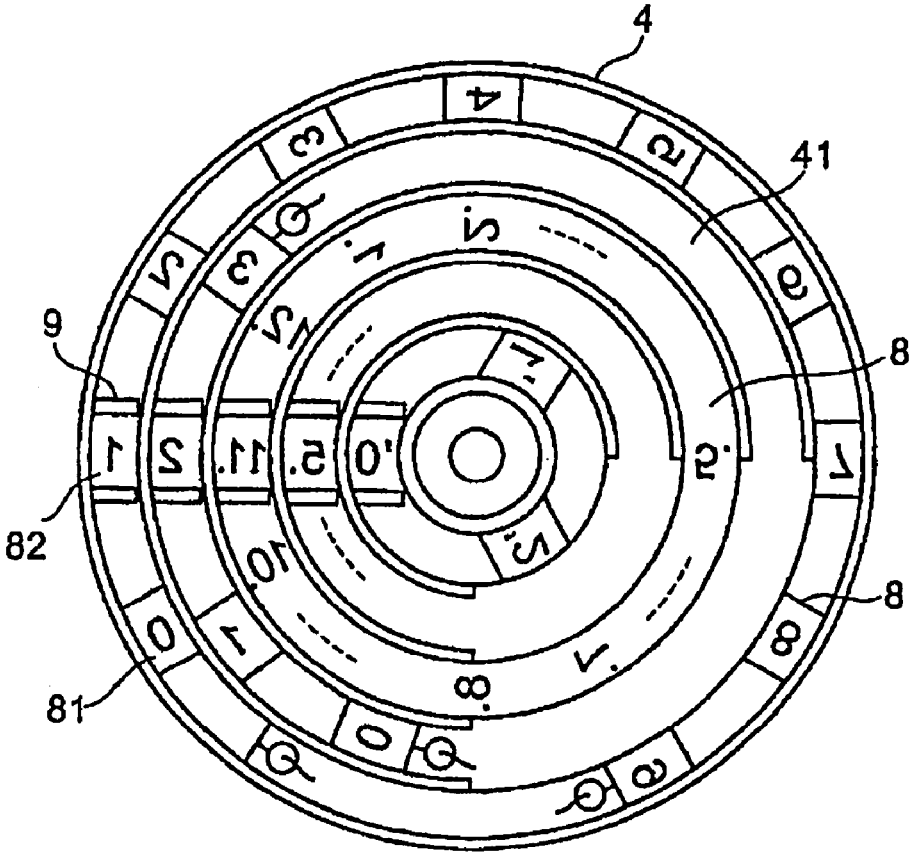
FIG. 9 is a plan view showing a typing device.

FIG. 9 is a plan view of the typing device, and showing an example in which the type units of FIG. 4 are used.

FIG. 9 also shows, each of the type units 8 indicating year-month-day order from an inner side of said type case 4 is inserted into each of the grooves 41 shown in FIG. 3.

By setting the type blocks 82 of the type units 8 into the type bases 9 fixed in a line in the printing position, a given date, for example, "Nov. 11, 2005" is set. With regard to the indication of the date, it is possible to support indication in different languages by changing the type units 8.

The type unit 8 which is formed in the annular shape is required for reasonable dimensional accuracy. However, the type case 4 is provided with the non-groove area 43, so increased redundancy make it possible to have the relaxed dimensional accuracy.

In addition, when the both ends of the type unit 8 are formed to be the terminal ends like a day indication of FIG. 9, the dimensional accuracy regarding the length thereof is not required at all, since the type blocks 82 are loosely coupled.

Note that, also in the case of using the type units of FIG. 5, the typing device can be structured in the same manner. In particular, when the type unit 800 is structured in the annular shape and the protrusion-like tab is formed on any of the coupling portions 803, rotating movement of the endless type unit 800 is facilitated on said protrusion-like tab, thereby users can set a given date easily.

Figure 10:
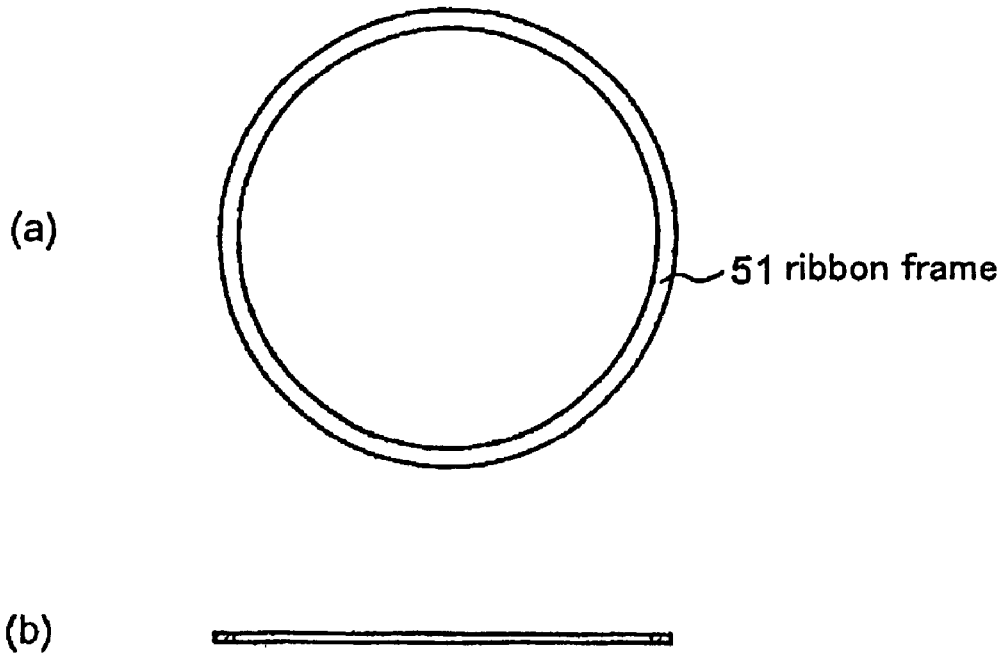
FIG. 10 is a view showing a ribbon frame.
Figure 11:
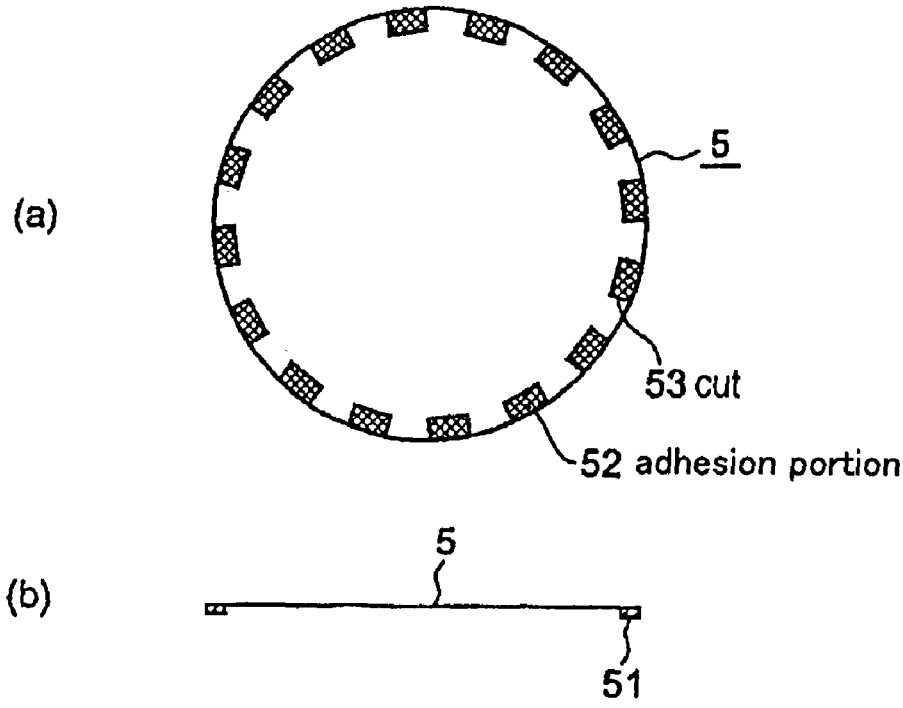
FIG. 11 is a view showing a printing ribbon.

FIG. 10 is a view showing a ribbon frame, in which a part (a) is a plan view and a part (b) is a sectional view. FIG. 11 is a view showing the printing ribbon, in which a part (a) is a plan view of a back surface and a part (b) is a sectional view.

A ribbon frame 51 is a frame to which the printing ribbon 5 is mounted, and is formed of a synthetic resin or the like into a ring shape.

The printing ribbon 5 is formed of carbon paper, ink ribbon, or the like into a circular shape, and a peripheral portion on the back surface thereof, which is not a printing surface, selectively serves as a adhesion portion 52 to be adhered to the ribbon frame 51. Further, both sides of the adhesion portion 52 are formed with cuts 53.

The cuts 53 serves to ease tension caused by expansion of the printing ribbon 5 when the printing ribbon 5 is allowed to expand in the case, when the types protrude to push up the printing ribbon 5 during printing. However, the cuts 53 are not necessarily provided, if said printing ribbon 5 has stretching flexibility.

Since the printing ribbon 5 is formed in the circular shape, a new printing surface of the printing ribbon 5 can be used every time by rotating the printing ribbon by an amount used for printing the given date.

Note that, a shape of the printing ribbon 5 is not restricted to the precise circular shape. It may also be of a polygonal shape close to the circular shape or the like.

In this manner, it is possible to realize the smaller and thinner printer by adopting the planer printing ribbon 5 of the circular shape.

Figure 12:
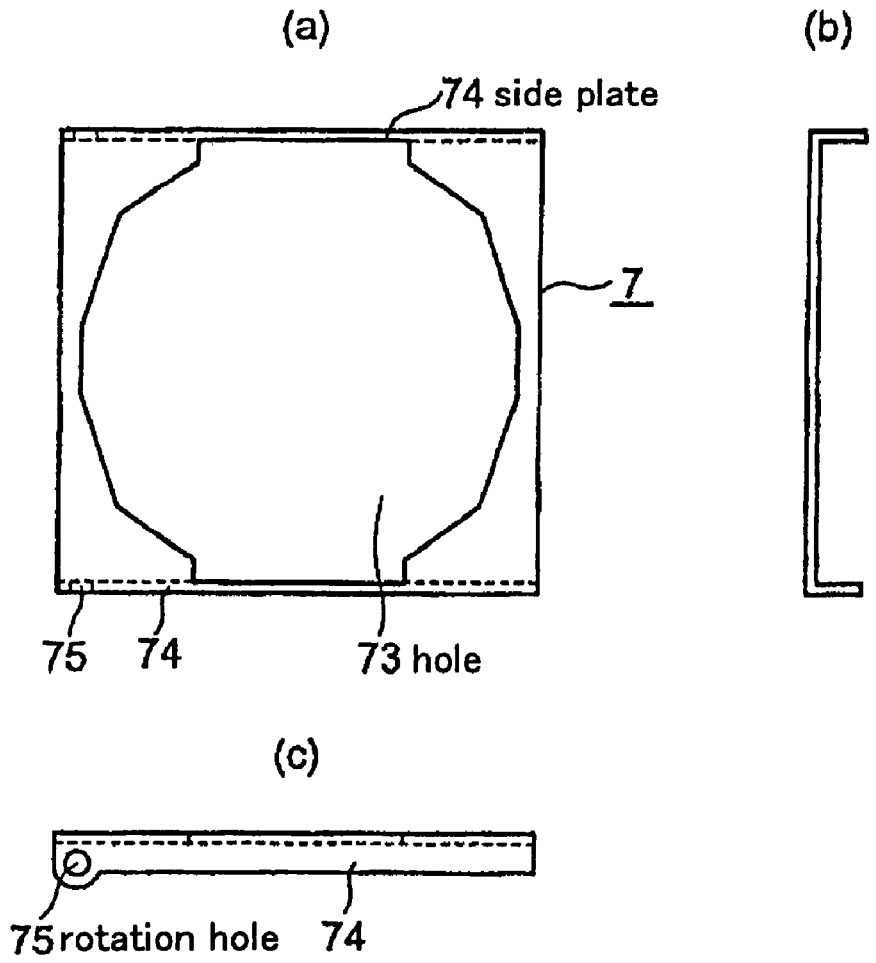
FIG. 12 is a view showing a protector frame.
Figure 13:
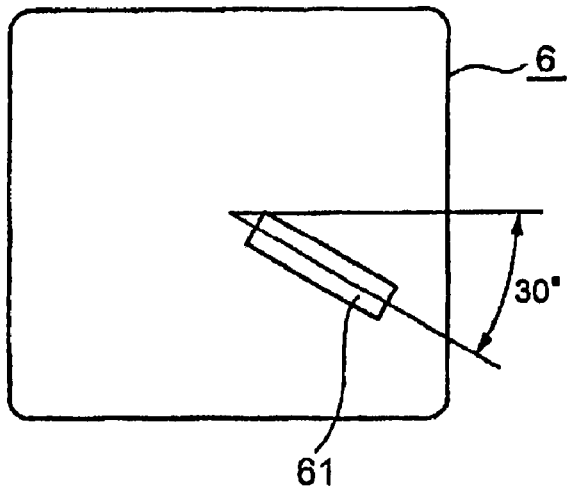
FIG. 13 is a plan view of a ribbon protector.

FIG. 12 is a view showing the protector frame, in which a part (a) is a plan view, a part (b) is a front view, and a part (c) is a side view. FIG. 13 is a front view of the ribbon protector.

The protector frame 7 is formed by machining a metal plate, for example, an aluminum plate, is provided with a large hole 73 bored in a center thereof, and is provided with the ribbon protector 6 fixed to a frame portion on a periphery thereof by an adhesive or the like.

The ribbon protector 6 serves for protecting the printing ribbon 5 shown in FIG. 11, is formed of a thin metal plate, for example, a stainless steel plate, and has the window 61 defining the printing position formed at an angle of 30°. The inclination of the window 61 is as described with reference to FIG. 1.

The protector frame 7 to which the ribbon protector 6 is fixed is provided with rotation holes 75 on left ends of both side plates 74 shown in the part (c) of FIG. 12 so that said protector frame 7 can be opened by rotating toward the upper side in the longitudinal direction of the business card case shown in FIG. 1.

The shaft 71 shown in FIG. 2 is inserted through the rotation holes 75, and the shaft 71 is fixed to the lower case 2, so the protector frame 7 is supported so as to controllably rotate about the shaft 71 as an axis.

Accordingly, the ribbon protector 6 fixed to the protector frame 7 can be opened and closed by rotating about the shaft 71.

Next, the printing operation will be described.

First, as shown in FIG. 1, the upper case 1 is opened and the plurality, for example, ten sheets of cards 34 are contained in the card containing section 3.

Next, the ribbon protector 6 fixed to the protector frame 7 is rotated to the left about the shaft 71 of FIG. 2 as a rotation axis, thereby being opened. In the state of FIG. 1, it rotated upwardly to be opened.

Next, the printing ribbon 5 is removed to expose the type case 4 to outside, and as shown in FIG. 9, the type units 8 arranged in the grooves 41 of the type case 4 are pulled along the grooves 41 by picking by fingers or the like to allow the type blocks 82 into the type bases 9 to set the types 81 on the type blocks 82 to the date to be printed, for example, "Nov. 11, 2005".

In this state, the printing ribbon 5 and the ribbon protector 6 are returned to original positions, thereby completing preparation for the date printing.

Figure 14:
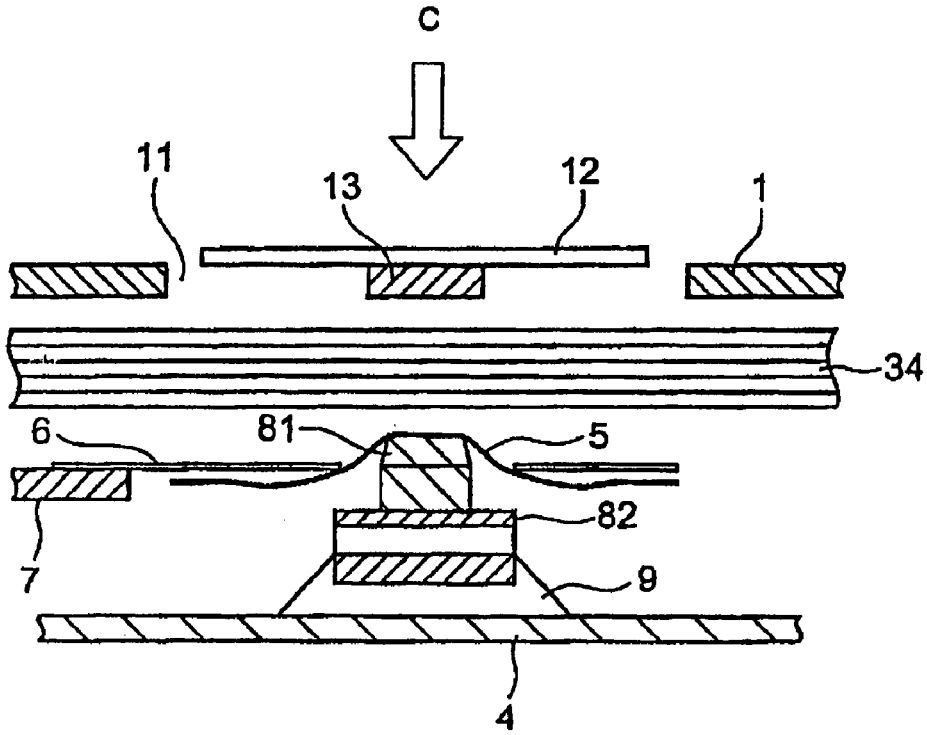
FIG. 14 is an enlarged sectional view of a printing portion.

FIG. 14 is an enlarged sectional view of a printing portion, and showing a state where the above-mentioned date printing is prepared.

In this state, the type blocks 82 are allowed to fit into the type bases 9. Therefore, the types 81 are positioned at a level higher (e.g. by 1 mm), push up the printing ribbon 5, and protrude from the window of the ribbon protector 6 by about 1 mm.

Here, when the pressing rubber 12 is pressed by a finger in a direction of an arrow C of FIG. 14, the pressing block 13 protrudes from the hole 11 of the upper case 1 downwardly, that is, in the printing direction, thereby moving the entirety of the plurality of cards 34, which are contained, in the printing direction.

The lowermost card 34 which is moved comes into contact with the printing ribbon 5, and is impressed to the types 81 through the intermediation of the printing ribbon 5, so the given date as shown in FIG. 9 is printed on the business card 34.

When the finger is released to stop pressing, the pressing block 13 is urged to the direction opposite to the printing direction by the restoring force of the pressing rubber 12 to be returned to the original position.

The business card 34 on which the date is printed is supported by the ribbon protector 6 urged upwardly by the spring 72 provided between the rower case 2 and the protector frame 7 as shown in FIG. 2.

Next, by opening the upper case 1 as shown in FIG. 1, the business card 34 on which the date is printed appears on the top, so the business card 34 can be taken out of the card containing section 3 to exchange cards immediately.

When printing two or more cards, it suffices that the above-mentioned printing operation is repeated.

Further, when changing the date, it suffices that the ribbon protector 6 is opened, the printing ribbon 5 is removed, and the date is set in the same manner as described above.

As described above, according to Embodiment 1, the business card case includes the printing hammer means, the printer having the typing device, and the card containing section, thereby making it possible to print the date on the business cards in the business card case by pressing the printing hammer means.

Thus, by setting the types to the current date in advance, when exchanging the business cards, it is possible to print the date and hand the business card with the date to a person with whom the business cards are exchanged.

Further, there is no need for electric power and electronic control, so it is possible to realize the light and inexpensive business card case with a printing function.

Further, the types are aligned concentrically to constitute the thin typing device, so the thin business card case with a printing function can be realized.

Embodiment 2

Figure 15:
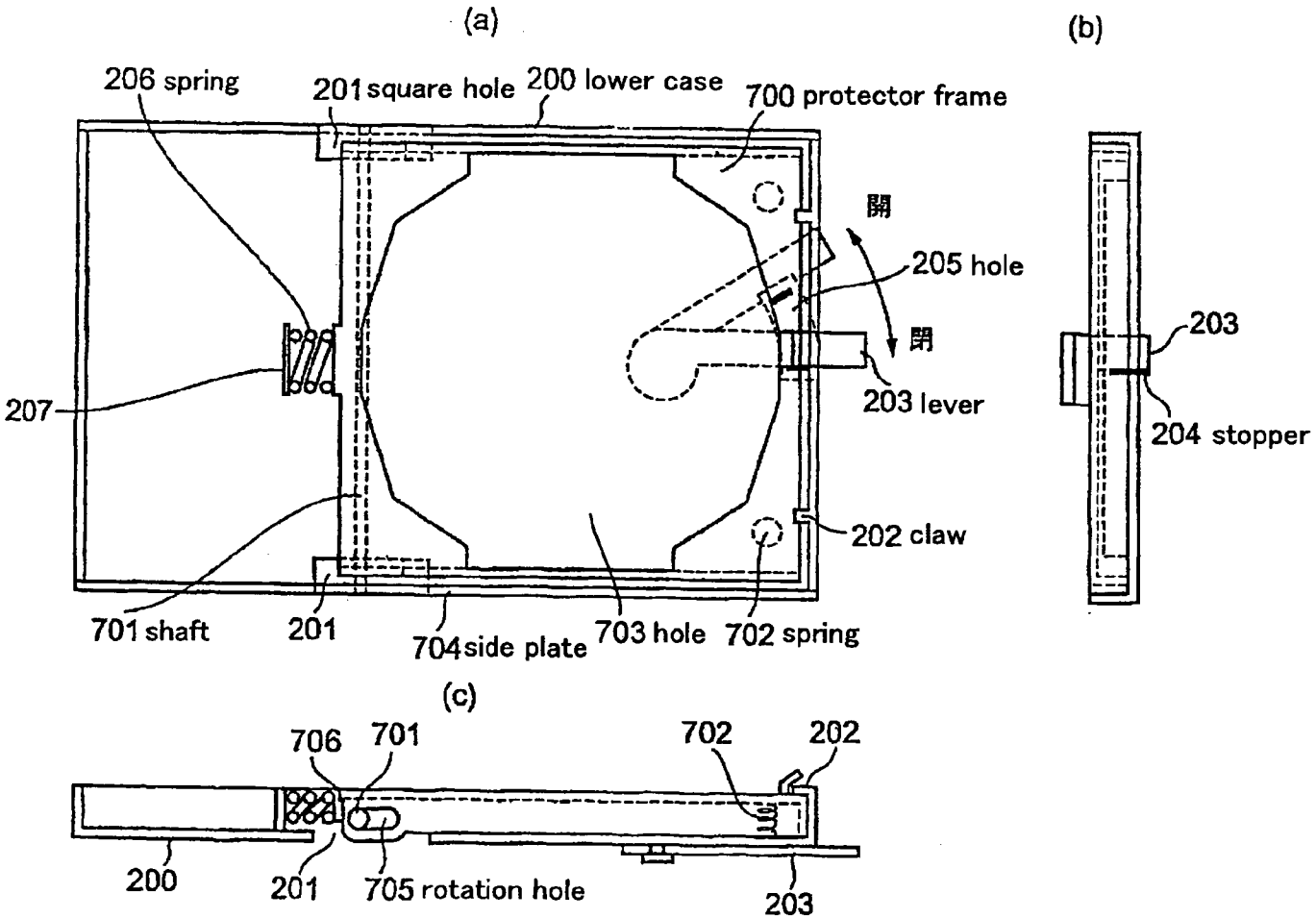
FIG. 15 is a view showing a business card case according to Embodiment 2 of the present invention.

FIG. 15 is view of a business card case with a printing function according to Embodiment 2 of the present invention, showing a state where the upper case is removed, in which a part (a) is a plan view, a part (b) is a front view, and a part (c) is a side view with a side plate being removed.

In Embodiment 2, in order to prevent the business card from being unwittingly soiled by coming into contact with the printing ribbon when the printing operation is not performed, a lower case 200 and a protector frame 700 are mainly devised. Other details are the same as those of Embodiment 1, so a description will be made only of modified portions.

The lower case 200 is provided with square holes 201 in mounting positions of a shaft 701 of the protector frame 700, and is provided with two claws 202 on a front side thereof, that is, on an upper end of right side in the parts (a) and (c) of FIG. 15. Note that, grooves for accommodating the claws 202 are formed in corresponding portions of the upper case.

On a bottom surface of the lower case 200, a lever 203 constituting a mechanism for locking the protector frame 700 is rotatably attached. A stopper 204 used in locking the protector frame 700 is integrally formed on the lever 203. In a bottom plate of the lower case 200 there is formed a hole 205 for allowing movement of the stopper 204.

Further, the lower case 200 is provided with a spring 206 for urging the protector frame in the front direction, that is, right direction of the parts (a) and (c) of FIG. 15, and a support body 207 for fixing the spring 206.

Figure 16:
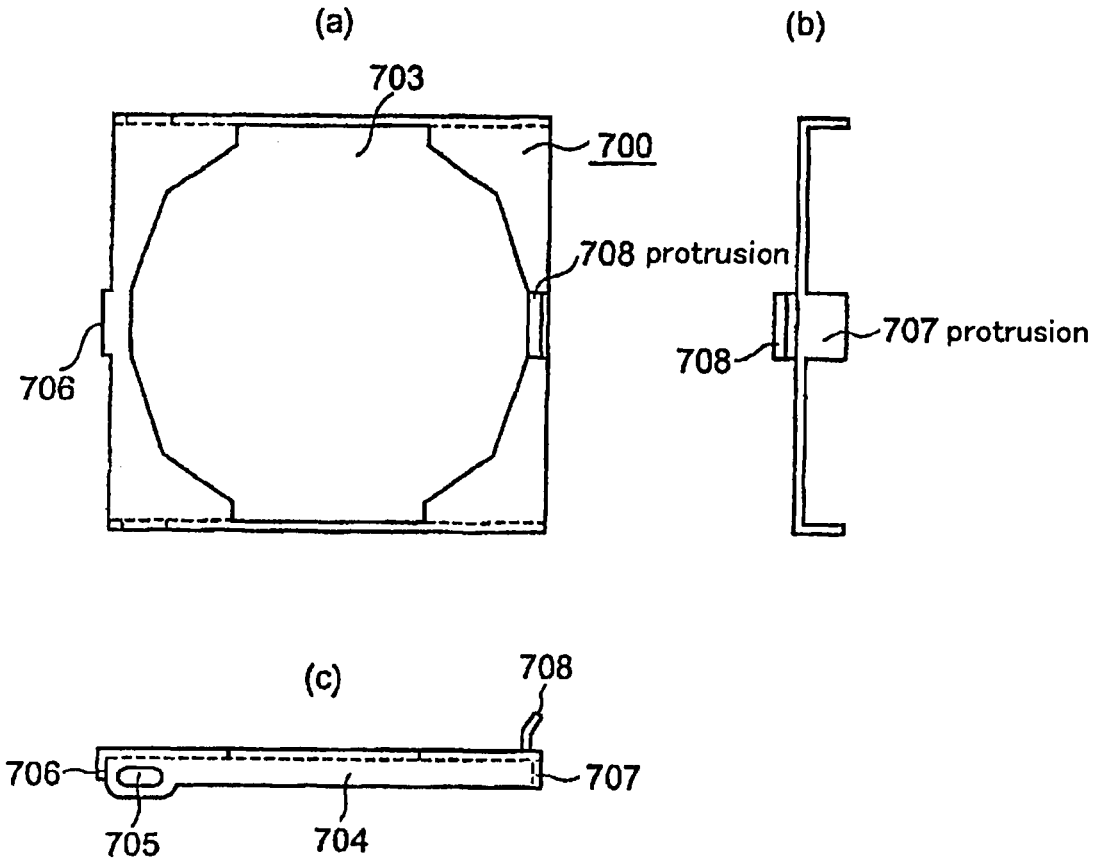
FIG. 16 is a view showing a protector frame.

FIG. 16 is a view showing a protector frame, in which a part (a) is a plan view, a part (b) is a front view, and a part (c) is a side view.

A description will be made to the protector frame 700 with reference to FIG. 15. The protector frame 700 is provided with, in the same manner as in Embodiment 1, a shaft 701 for allowing opening and closing through rotation, springs 702, a hole 703, and side plates 704.

Unlike in Embodiment 1, the rotation hole 705 is formed in an oval shape and the protector frame 700 can move in frontward and rearward direction with respect to the shaft 701 fixed to the lower case 200, that is, to right and left direction in the parts (a) and (c) of FIG. 15. Bulges on portions, in which the rotation holes 705 are provided, enter the square holes 201 provided in the lower case 200, forming relief therefor.

Further, in the parts (a) and (c) of each of FIGS. 15 and 16, on the left end, there is formed the support body 706 for the spring 206, and on a lower side of the right end, there is formed a protrusion 707, and on an upper side thereof, there is formed a protrusion 708. The support body 706, the protrusion 707, and the protrusion 708 are formed by machining the end portions of the protector frame 700.

Figure 17:
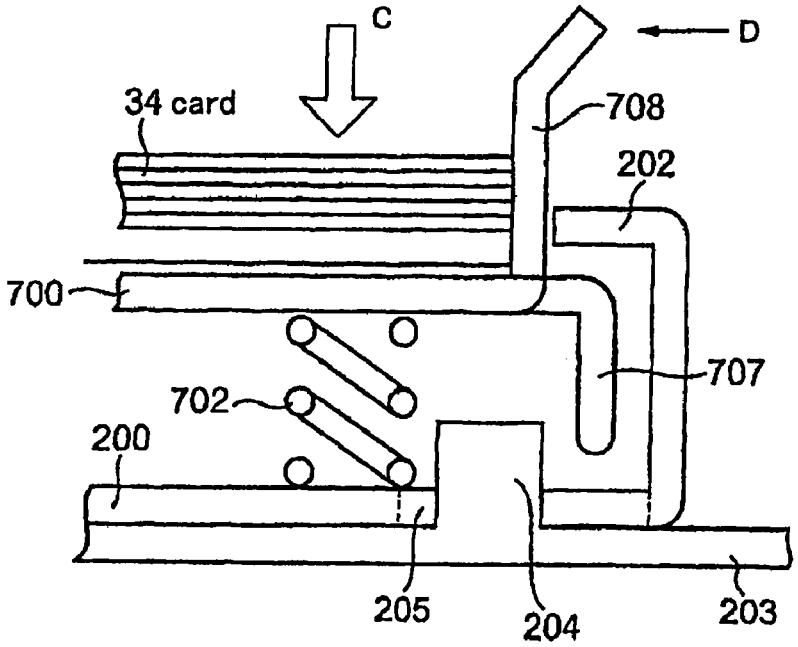
FIG. 17 is a view showing a lever-opened state.
Figure 18:
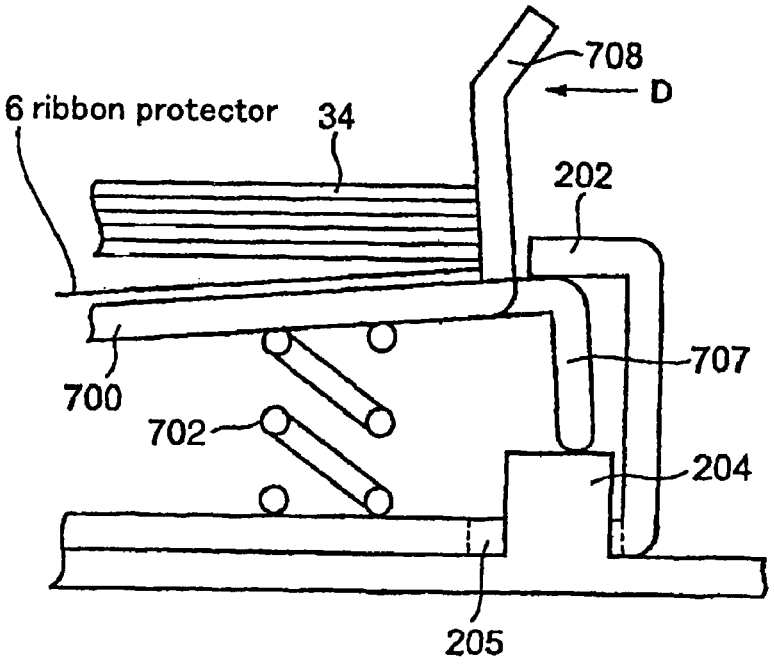
FIG. 18 is a view showing a lever-closed state.

FIG. 17 is a view showing a lever-opened state. FIG. 18 is a view showing a lever-closed state.

The lever 203 is, as shown in FIG. 15, rotatably supported on the lower case 200. Therefore, when the lever is rotated to realize the lever-opened state as shown in FIG. 17, the stopper 204 of the lower case 200 moves in the hole 205, and the stopper 204 is spaced apart from the protrusion 707 of the protector frame 700, thereby realizing a printable state where the protector frame 700 is supported by the springs 702. Thus, if the types for a given date are set, through the pressing in the direction of the arrow C with a finger as shown in FIG. 14, it is possible to print the date on the name card 34.

When the printing is not performed, as shown in FIG. 15, the lever 203 is allowed to rotate by a finger to realize the closed state as shown in FIG. 18, an upper end of the protector frame 700 lifted up by the springs 702 in the direction opposite to the printing direction is pressed by the claws 202 of the lower case 200, then said upper end of the protector frame 700 is locked by the stopper 204 moved in the hole 205 so that a tip of the protrusion 707 does not lower.

In this manner, the name card 34 is supported by the ribbon protector 6 fixed to the protector frame 700, and does not move down further in the printing direction from this position. That is, the protector frame 700 and the ribbon protector 6 are locked in a state where they are lifted up to a higher position than the position shown in FIG. 14, and the name card 34 supported by the ribbon protector 6 is spaced apart from the printing ribbon 5, thereby regulating the movement thereof in the downward direction, that is, the printing direction.

Accordingly, even when the hammer means is accidentally pressed when the printing is not performed, the name card 34 cannot move in the printing direction, and therefore there is no case of the name card 34 coming into contact with the printing ribbon 5 to be soiled.

When the ribbon protector 6 is opened to change the date, the upper case 1 is opened as shown in FIG. 1, and in either of FIGS. 17 and 18, it is possible to open the ribbon protector 6 by pushing the protrusion 708 of the protector frame 700 in the direction of the arrow D to prevent the protrusion 707 from being caught by the claws 202, and then lifting up the protrusion 708 upwardly, thereby rotating the protector frame 700.

As described above, according to Embodiment 2, in addition to the effect of Embodiment 1, there is provided a mechanism of locking the ribbon protector wherein the ribbon protector is lifted up in the direction opposite to the printing direction, and unlocking operation is needed to print a date. Therefore, it is possible to prevent the business card from coming into contact with the printing ribbon to be soiled when the printing is not performed.

FIG. 1
1 UPPER CASE
2 LOWER CASE
3 CARD CONTAINING SECTION
4 TYPE CASE
5 PRINTING RIBBON
6 RIBBON PROTECTOR
7 PROTECTOR FRAME
11 HOLE
12 PRESSING RUBBER
13 PRESSING BLOCK
31 CARD BLOCK
32 CARD PLATE
34 CARD
61 WINDOW

Perspective View Showing Business Card Case According to Embodiment 1

FIG. 2
71 SHAFT
72 SPRING

View Showing Business Card Case According to Embodiment 1

FIG. 3
4 TYPE CASE
41 GROOVE
42 WALL
43 NON-GROOVE AREA

View Showing Type Case

FIG. 4
8 TYPE UNIT
81 TYPE
82 TYPE BLOCK
83 SPACER
84 STRING
85 THROUGH HOLE
86 STOPPER

View Showing Example of Type Unit

FIG. 5
800 TYPE UNIT
801 TYPE
802 TYPE BLOCK
803 COUPLING PORTION

View Showing Another Example of Type Unit

FIG. 6
9 TYPE BASE
91 SLOPE
92 DEPRESSED PORTION

View Showing Type Base

FIG. 7

View Showing State where Type Block is Allowed to Fit into Type Base

FIG. 8

View Showing State where Another Type Block is Allowed to Fit into Type Base

FIG. 9

Plan View of Typing Device

FIG. 10
51 RIBBON FRAME

View Showing Ribbon Frame

FIG. 11
52 ADHESION PORTION
53 CUT

View Showing Printing Ribbon

FIG. 12
73 HOLE
75 SIDE PLATE
75 ROTATION HOLE

View Showing Protector Frame

FIG. 13

Plan View of Ribbon Protector

FIG. 14

Enlarged Sectional View of Printing Portion

FIG. 15
200 LOWER CASE
201 SQUARE HOLE
202 CLAW
203 LEVER
204 STOPPER
205 HOLE
206 SPRING
700 PROTECTOR FRAME
701 SHAFT
702 SPRING
703 HOLE
704 SIDE PLATE
705 ROTATION HOLE
(1) OPEN
(2) CLOSE
(3) VIEW SHOWING BUSINESS CARD CASE ACCORDING TO EMBODIMENT 2

FIG. 16
707, 708 PROTRUSION

Showing Protector Frame

FIG. 17
34 CARD

View Showing Lever-Opened State

FIG. 18
6 RIBBON PROTECTOR

View Showing Lever-Closed State

The invention claimed is:

1. A typing device, comprising:

a plurality of type units for printing date, in which a plurality of type blocks having types on upper surfaces thereof are coupled to each other so that the type blocks can move up and down;

a type case having a plurality of grooves, into which the plurality of type units are inserted, formed concentrically; and a type base fixed to a predetermined position on the type case, for positioning the type blocks for setting the date whereby each of the type blocks has a through hole formed therein, and the plurality of type blocks are loosely coupled to each other by a string passing through the through holes with intermediations of spacers.

2. The typing device according to claim 1, characterized in that the plurality of type blocks and coupling portions between the type blocks are integrally formed, and an entirety of those is formed in a circular arc shape corresponding to each of the grooves.

3. The typing device according to claim 1, characterized in that the type blocks are coupled in an annular shape.

4. The typing device according to claim 2, characterized in that the type blocks are coupled in an annular shape.

5. The typing device according to claim 1, characterized in that both ends of the coupled type blocks are terminal ends.

6. The typing device according to claim 2, characterized in that both ends of the coupled type blocks are terminal ends.

7. A business card case with a printing function, comprising:

an upper case provided with printing hammer means;

a lower case connected to the upper case so that the upper case is freely opened and closed;

a card containing section formed in an inside of the cases; and a printer, comprising:

a typing device comprising: a plurality of type units for printing date, in which a plurality of type blocks having types on upper surfaces thereof are coupled to each other so that the type blocks can move up and down; a type case having a plurality of grooves, into which the plurality of type units are inserted, formed concentrically; and a type base fixed to a predetermined position of the type case, for positioning the type blocks for setting the date;

a printing ribbon arranged on the typing device; and a ribbon protector provided with a window which is arranged on the printing ribbon, and through which a type set in a printing position protrudes, the printer being provided for printing date on a business card contained in the card containing section, characterized in that the print hammer means is pressed to impress the business card to the type through an intermediation of the printing ribbon to thereby print the date.

8. The business card case with a printing function according to claim 7, characterized in that the print hammer means comprises a pressing rubber fixed to the upper case and a pressing block fixed to the pressing rubber.

9. The business card case with a printing function according to claim 7, characterized in that the card containing section comprises a card block of an angular U-shaped configuration fixed to the upper case and a card plate for covering the card block.

* * * * *